US009592842B1

(12) United States Patent
Mercer

(10) Patent No.: US 9,592,842 B1
(45) Date of Patent: Mar. 14, 2017

(54) RAILROAD LOCOMOTIVE CONTROL SYSTEM HAVING SWITCH POSITION INDICATION AND METHOD OF USE

(71) Applicant: John Mercer, Dade City, FL (US)

(72) Inventor: John Mercer, Dade City, FL (US)

( * ) Notice: Subject to any disclaimer, the term of this patent is extended or adjusted under 35 U.S.C. 154(b) by 0 days.

(21) Appl. No.: 14/845,200

(22) Filed: Sep. 3, 2015

(51) Int. Cl.
*B61L 3/00* (2006.01)
*B61L 5/00* (2006.01)
*B61L 23/04* (2006.01)

(52) U.S. Cl.
CPC ..... *B61L 3/006* (2013.01); *B61L 5/00* (2013.01); *B61L 23/04* (2013.01)

(58) Field of Classification Search
CPC .. B61L 3/00; B61L 3/006; B61L 3/008; B61L 5/00; B61L 5/10; B61L 5/107; B61L 7/088; B61L 1/00; A63H 19/14; A63H 19/36; B60L 15/40; B60L 2200/26; B60M 3/00; B60M 5/00; E01B 7/02; E01B 7/22; Y02T 90/16; Y02T 90/162
USPC ..... 701/19; 246/218, 220, 403, 415 R, 449, 246/452; 446/410, 441
See application file for complete search history.

(56) References Cited

U.S. PATENT DOCUMENTS 1,412,136 A * 4/1922 Rebori ..... B61L 5/00 246/403
2002/0040952 A1* 4/2002 Steinmann ..... B61L 5/00 246/415 R
2002/0096604 A1* 7/2002 Hager ..... B61L 5/107 246/220
2003/0106967 A1* 6/2003 Brushwood ..... B61L 5/00 246/220
2003/0201368 A1* 10/2003 McQuistian ..... B61L 5/00 246/452

(Continued)

FOREIGN PATENT DOCUMENTS

GB 191112539 A * 0/1912 ..... B61L 5/00
GB 403591 A * 12/1933 ..... B61L 5/00

OTHER PUBLICATIONS

"How Trains Change Tracks?" on You Tube published on Mar. 25, 2013; https://www.youtube.com/watch?v=L_wOPY5Pu-A.*

(Continued)

*Primary Examiner* — Mussa A Shaawat
*Assistant Examiner* — Sanjeev Malhotra
(74) *Attorney, Agent, or Firm* — Gulf Coast Intellectual Property Group

(57) ABSTRACT

A locomotive control system and method of use operable to provide operational control of a locomotive ensuing the detection that the locomotive will enter a railroad switch having the point blades incorrectly positioned. The locomotive control system further includes a point alignment detection sensor being operably coupled to a railroad switch and the point blades thereof. A plurality of track transceivers are mounted adjacent to the railroad switch and extend outward from the railroad switch along the railroad track. At least one engine transceiver is provided and is operably coupled to a locomotive. A controller is included and functions to provide logic and control of the locomotive control system. The method provides monitoring of the point blades of a railroad switch and detection of the movement of an approaching locomotive having entered the detection zone and is operable to prevent movement through the railroad switch if damage will occur thereto.

6 Claims, 4 Drawing Sheets

(56) References Cited

U.S. PATENT DOCUMENTS

| | | | | |
|---|---|---|---|---|
| 2005/0178929 | A1* | 8/2005 | Biagiotti | B61L 5/00 246/449 |
| 2006/0009117 | A1* | 1/2006 | Severson | A63H 19/14 446/410 |
| 2009/0029626 | A1* | 1/2009 | Severson | A63H 19/14 446/441 |
| 2015/0329128 | A1* | 11/2015 | Porsch | B61L 3/006 701/19 |
| 2016/0046306 | A1* | 2/2016 | Miyajima | B60L 15/40 701/19 |
| 2016/0172881 | A1* | 6/2016 | Birrer | B61L 1/00 246/218 |

OTHER PUBLICATIONS

"How a Rail Switch Works" on You Tube published on Mar. 5, 2013; https://www.youtube.com/watch?v=0boVAFc0_S4.*

"Railroad Switches and How They Work" on You Tube published on Aug. 17, 2014; https://www.youtube.com/watch?v=Xfqt33x0QcQ.*

"Alarm system for railway points has differential movement of switch blades operating signal contacts to actuate alarm", by Emmrich et al., DD 130414 A, filed Aug. 19, 1976; 2 pages of translated Text.*

* cited by examiner

RAILROAD LOCOMOTIVE CONTROL SYSTEM HAVING SWITCH POSITION INDICATION AND METHOD OF USE

FIELD OF THE INVENTION

The present invention relates generally to railroad safety devices, more specifically but not by way of limitation, a railroad switch position indicator system that is operable to locomotives from making trailing movements through switches that are lined thereagainst.

BACKGROUND

Railroads were one of the first major forms of transportation in the early development of the United States. The completion of an intercontinental railroad spurred the development of the western portion of the United States as the mode of transportation provided an economical and timely means of transporting goods and people across the country.

Today, the modern railroad system is an important part of economy. While the passenger travel is limited to commuter trains and relatively short distances, the railroad is responsible for the delivery of more commercial cargo than any other type of transportation. Rail is the most cost effective manner in delivering large amounts of goods. Our railway system in the United States consists of over 200,00 miles of tracks. As part of these tracks, there are switches that are operable to route trains in a desired direction.

Railroad switches are designed to guide the wheels of the train in one of two directions. The moving pieces of the switch are commonly referred to as points and the crossing creates a gap in the rail for a wheel flange to pass through so as to direct the train in the desired direction. The points are connected with at least one stretcher bar to ensure that one of the points is against the stock rail and the other point is clear to provide room for the wheel flange. The movement and control of the switches can be accomplished utilizing several devices such as but not limited to an electric/hydraulic control unit that moves the switch intermediate its first and second position.

When traversing through switches, the movements of the train traversing therethrough is categorized as either a facing movement or a trailing movement. A train coming from either of the converging directs will pass through the points onto the narrow end, regardless of the position of the points and the wheels will force the points to move. Passage through a switch in this direction is known as a trailing point movement. Trailing movements through switches lined against them, known as running through a switch, continues to be a problem in our modern railroad system. When this occurs the switch is damaged and requires repair and unless repaired can cause safety hazards such as but not limited to train derailment. Additionally, the running through of switches costs the railroad industry millions of dollars per year in repair costs and damages. While currently there are visual signals that alert operators as to the position of the switch, the current technology has proven ineffective in preventive thousand of instances of running through switches each year.

Accordingly, there is a need for a railroad switch position indication system and method that would provide notification to an approaching train that the switched is lined against the approaching train and further provide operational override if the locomotive engineer provide corrective action.

SUMMARY OF THE INVENTION

It is the object of the present invention to provide a railroad switch position indication system that provides notification to a locomotive operator, both remote and/or in the locomotive an alert that the train is approaching a switch in a position lined against it.

Another object of the present invention is to provide a railroad switch position indication system that includes a point alignment detection sensor that is operable to detect the position of a railroad switch.

A further object of the present invention is to provide a railroad switch position indication system that further includes a switch position transmitter, wherein the switch position transmitter transmits position data from the point alignment detection sensor to a plurality of locations.

An additional object of the present invention is to provide a railroad switch position indication system that further includes a plurality of receivers located on both the locomotive and remote control equipment.

Still another object of the present invention is to provide a railroad switch position indication system that provides both a visual and an audio warning signal of a potential running through the switch scenario.

Yet a further object of the present invention is to provide a railroad switch position indication system that further includes an operational override module that will provide control of the locomotive if the railroad switch position indication system detects a potential run through scenario.

An alternative object of the present invention is to provide a railroad switch position indication system wherein each switch utilizes paired transmitters and receivers so as to ensure proper identification of each switch in a railroad system.

Another object of the present invention is to provide a railroad switch position indication system that includes a warning zone track portion wherein the warning zone track portion is contiguous with each railroad switch and function to begin to provide a potential run through switch scenario alerts so as to enable either the operator or operational override module to prevent the pending run through switch event.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
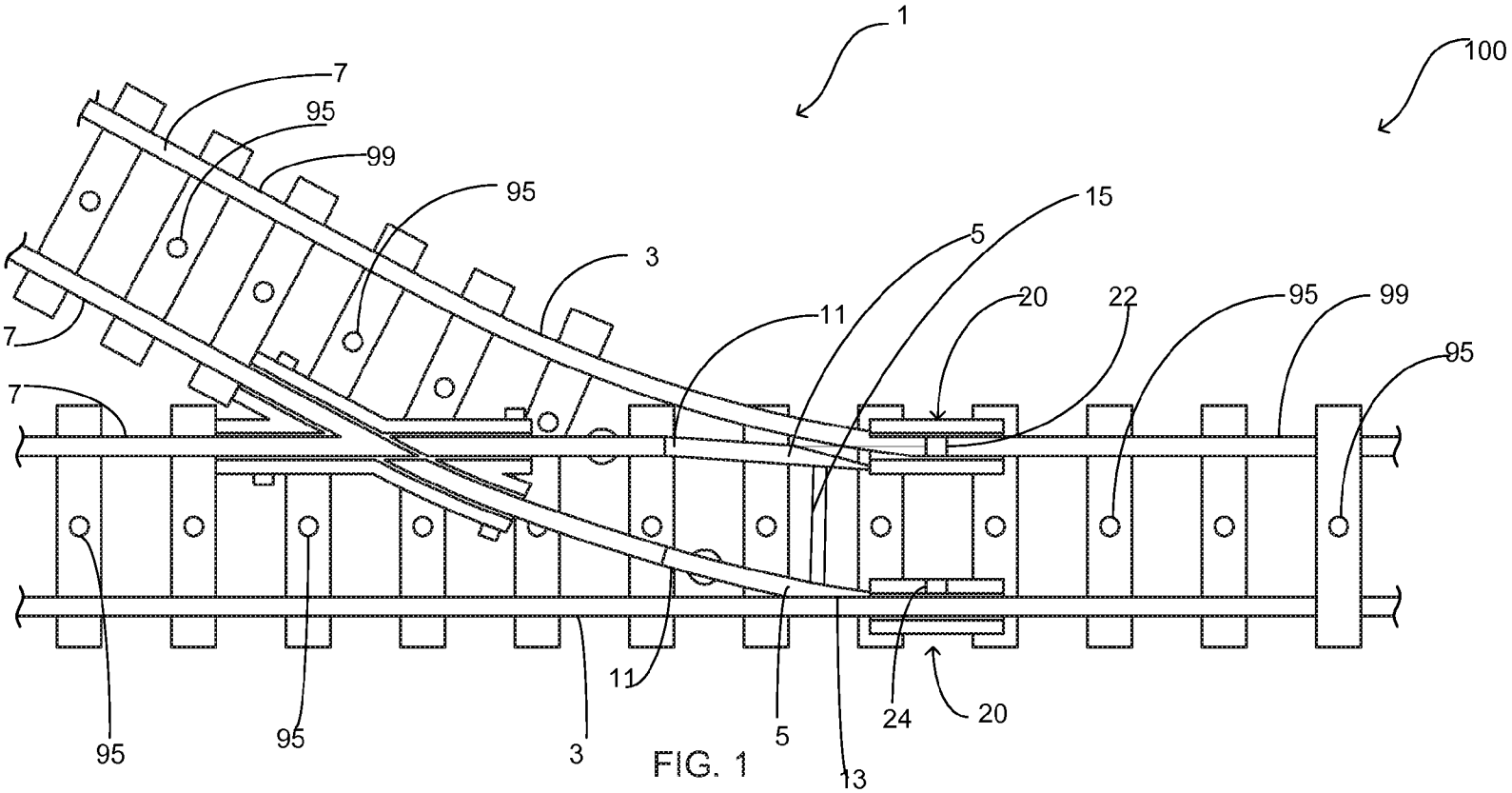
FIG. 1 is a diagrammatic top view of a switch having components of the present invention operably installed thereon.
Figure 2:
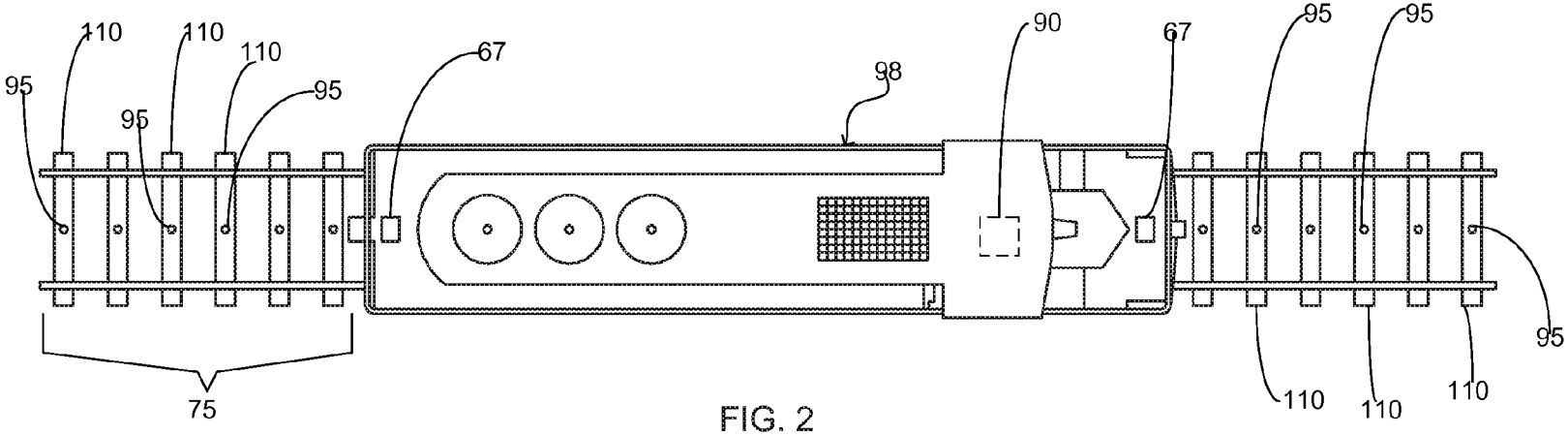
FIG. 2 is a top diagrammatic view of an exemplary railroad locomotive having elements of the present invention operably coupled therewith.

Referring now to the drawings submitted herewith, wherein various elements depicted therein are not necessarily drawn to scale and wherein through the views and figures like elements are referenced with identical reference numerals, there is illustrated a railroad locomotive control system having switch position indication 100 constructed according to the principles of the present invention.

Referring to FIG. 1 herein a railroad switch 1 is illustrated therein. The railroad switch 1 includes the conventional elements such as but not limited to stock rails 3, point blades 5 and running rails 7. As is commonly known, the point blades 5 include a heel portion 11 and a toe portion 13 and are operably coupled with at least one stretcher 15. The railroad locomotive control system having switch position indication 100 includes a point alignment detection sensor assembly 20 positioned on each track 99 proximate to the toe portion 13 of the point blades 5. The point alignment detection sensor assembly 20 is operable to detect and subsequently transmit the position of the point blades 5 relative to the track 99. The point alignment detection sensor assembly 20 includes the necessary electronics to receive, store, manipulate and transmit data pertaining to the position of the point blades 5. Detection of the point blade 5 position is contemplated to be detected using numerous available sensor technologies such as but not limited to electromagnets or lasers.

The point blades 5 as is known in the art are operable to be placed in a first position or a second position so as to provide directional change for a passing locomotive and rail cars. The point alignment detection sensor assembly 20 is powered utilizing conventional AC or DC power supplies. The point alignment detection sensor assembly 20 further includes a first transceiver 22 and a second transceiver 24 that are operable to transmit the position of the point blades 5 to either the track transceivers 95 or directly to the controller 90 of a locomotive. While a first transceiver 22 and second transceiver 24 are illustrated and discussed herein for detection of the position of the point blades 5, it is contemplated within the scope of the present invention that only a single transceiver could be utilized as part of the point alignment detection sensor assembly 20 in order to detect and transmit the position of the point blades 5. It is further contemplated within the scope of the present invention that the first transceiver 22, second transceiver 24 and track transceivers 95 could utilize a plurality of communication protocols in order to transmit and receive information. More specifically but not by way of limitation, communication protocols such as passive RFID, active RFID, microwaves or Bluetooth could be utilized to establish operable communication intermediate the first transceiver 22, second transceiver 24 and track transceivers 95.

The track transceivers 95 are mounted on the support members 110 utilizing suitable durable techniques and are mounted within a defined area proximate each railroad switch 1 that is installed as part of a conventional track system. The area in which the track transceivers 95 are mounted proximate the railroad switch 1 is the detection zone 75. The detection zone 75 is different for each railroad switch 1. The detection zone 75 is established based upon the typical tonnage of the train operating on the portion of track adjacent to the railroad switch 1 and further utilizes the parameter of operating speeds allowed for that portion of track adjacent to the railroad switch in order to determine the length of the detection zone 75, i.e. how far the most distal track transceiver 95 will be mounted from the railroad switch. By way of example but not limitation, in a rail yard the detection zone 75 may only be approximately four hundred feet as the speeds and tonnage of a train within a rail yard would allow for the railroad locomotive control system having switch position indication 100 to transmit the railroad switch 1 position in order to alert either an engineer or remote operate of a potential run through switch scenario and engage the override (discussed further herein) if required. Alternatively, for a railroad switch 1 that is located on a main operating line the detection zone 75 could be as great as several thousand yards based upon the aforementioned parameters. While track transceivers 95 are illustrated as being mounted on each adjacent support member 110 herein, it is contemplated within the scope of the present invention that the track transceivers 95 could be mounted at various distances within the warning zone 75 depending upon the type of communication protocol utilized and its optimum broadcast range.

The detection zone 75 includes a first operational mode and a second operational mode. In the first operational mode the track transceivers are continuously powered and active and will detect the presence of a locomotive 98 ensuing entry in the detection zone 75. In the second operational mode of the detection zone 75 the track transceivers 95 are in a passive state with the exception of the most distal track transceiver 95 relative to the switch 1. Subsequent a locomotive 98 traversing across the most distal track transceiver 95 in a detection zone 75, the detection zone 75 is transitioned to an active state wherein all the track transceivers 95 actively monitor the location of the locomotive 98 within the detection zone 75 and provide the functionality as described herein.

The point alignment detection sensor assembly 20 transmits the position of the point blades 5 to the track transceivers 95 disposed within the detection zone 75 which subsequently transmit the position signal to the train transceiver 67, which then transmits the signal to the controller 90. The train transceiver 67 is constructed in the same manner as the track transceivers 95 and is operably coupled to the controller 90. While two train transceivers 67 have been illustrated herein so as to provide detection during execution of either a facing movement or trailing movement into a railroad switch 1, it is contemplated within the scope of the present invention that the railroad locomotive control system having switch position indication 100 could include either one train transceiver 67 or a plurality thereof.

Figure 4:
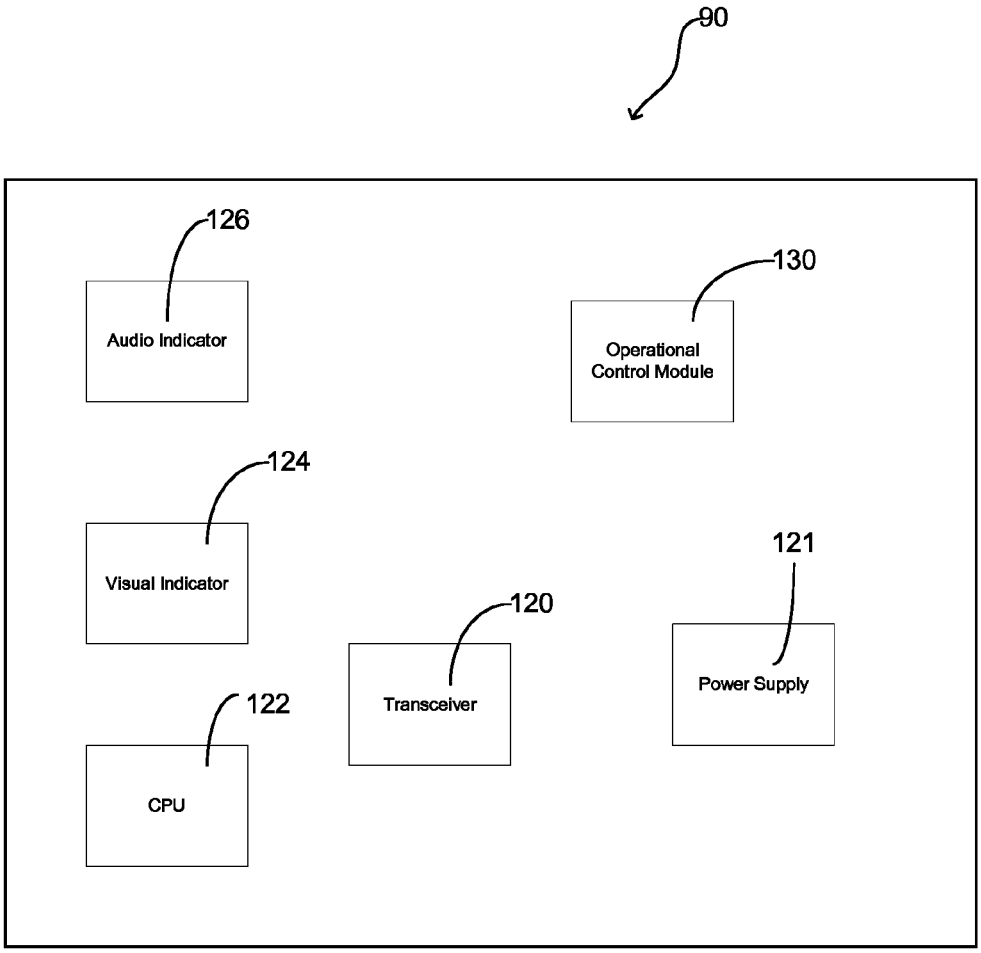
FIG. 4 is a block diagram of the controller of the present invention.

The controller 90 is illustrated diagrammatically herein but it should be understood that the controller 90 is operably place within a control station of a locomotive or integrally coupled with a remote operating station. The controller 90 further diagrammatically illustrated in FIG. 4 herein includes a transceiver 120 integrally mounted therewith that is communicably coupled with the track transceivers 95 and is operable to receive the signal therefrom. A central processing unit 122 is present within the controller 90 and contains the necessary electronics to receive, store, manipulate and transmit data. The central processing unit 122 further provides the algorithm calculation when a train is present in the detection zone 75 so as to determine when to provide the first warning signal and the second warning signal and subsequently engage the operational override if required. The central processing unit 122 is operably coupled to a visual indicator 124. Ensuing a locomotive 98 entering the detection zone 75, the controller 90 receives the signal from the track transceiver 95 as to the position of the railroad switch 1 being approached by the locomotive 98. If the point blades 5 are in a position wherein a trailing movement by the locomotive 98 would damage the railroad switch 1, i.e. running through the switch, the central processing unit 122 will transmit an instruction to the visual indicator 124 and the audio indicator 126. The visual indicator 124 is located either within the control station of the locomotive 98 or on a remote control unit (not illustrated herein) and is operable to provide a visual signal to the operator of the locomotive 98 that the locomotive 98 could potentially run through an approaching railroad switch 1 wherein the point blades 5 thereof are incorrectly positioned. The visual indicator 124 is constructed of a LED light or similar light and is operable to either emit a flashing pattern or a steady illumination. Additionally, in the aforementioned scenario, the central processing unit 122 transmits a signal to the audio indicator 126 also located within the control station of the locomotive 98 or a remote control unit wherein upon receipt of the signal the audio indicator 126 will emit an audio alarm so as to notify an operator of a potential situation wherein the locomotive 98 will run through an approaching railroad switch 1. The audio indicator is a conventional audio speaker and is operably coupled to the central processing unit 122 utilizing suitable techniques.

Operably disposed within the controller 90 is an operational control module 130. The operational control module 130 is operably coupled to the central processing unit 122 utilizing suitable techniques. The operational control module includes the necessary electronics to receive, store, transmit and manipulate data. The operational control module 130 is further operably coupled to a control station of the locomotive 98. As a locomotive 98 traverses through a detection zone 75, its speed and proximity to the railroad switch 1 is consistently communicated to the controller 90 wherein the controller 90 calculates of the potential of a pending railroad switch 1 run-through dependent upon the position of the point blades 5 and subsequently activates the visual indicator 124 and audio indicator 126. Ensuing the activation of the visual indicator 124 and audio indicator 126 the central processing unit 122 continues algorithm processing to determine if an operator of the locomotive 98 has taken the appropriate action to stop the locomotive 98 prior to entering the railroad switch 1 having the point blades 5 in the incorrect position. Ensuing detection that the locomotive 98 will enter the railroad switch 1 with the point blades 5 in an incorrect position and no receipt of control alteration by an operator of the locomotive 98 has been detected, the operational control module 130 which is operably coupled to the controls of the locomotive 98 will provide an override control of the locomotive 98 and prevent the locomotive 98 from entering the railroad switch 1 having the point blades 5 in the incorrect position. It is contemplated within the scope of the present invention that the operational control module 130 could accomplish the aforementioned through various techniques such as but not limited to application of brake and/or reduction of throttle. It is further contemplated within the scope of the present invention that the operational control module 130 is additionally configured to execute override control ensuing the expiration of a predetermined period of time subsequent the entry of a locomotive 98 into the detection zone 75. The time period in which to execute the override control will vary depending upon the switch location, i.e. the time period for a detection zone 75 proximate a switch 1 on a main line is different than that of the time period for a switch 1 located in a yard.

Figure 3:
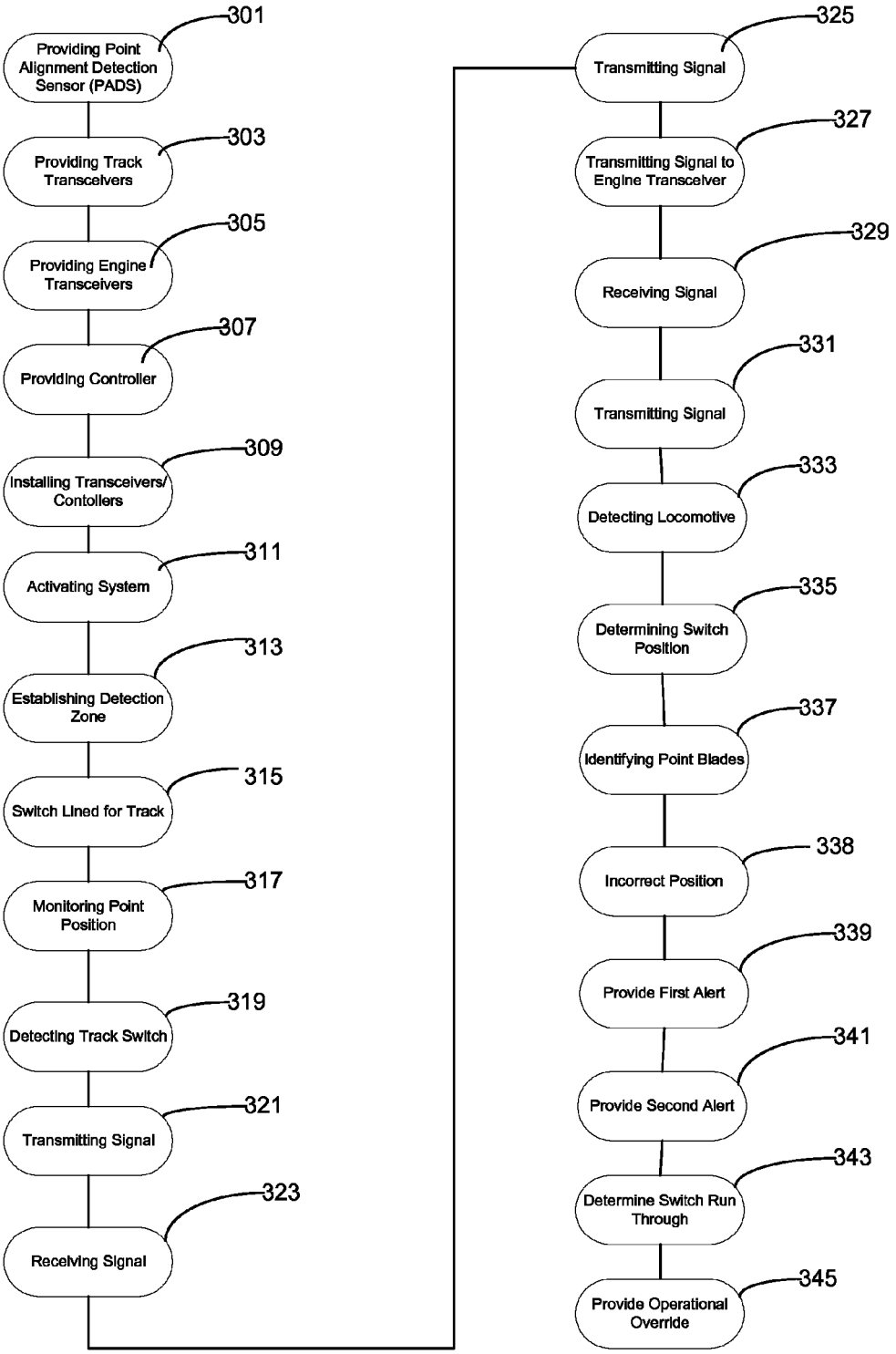
FIG. 3 is a flow chart of the operational method of the present invention.

Referring now to FIG. 3, the method of operation of the railroad locomotive control system having switch position indication 100 is illustrated therein. In step 301 a point alignment detection sensor assembly 20 is provided. Step 303, a plurality of track transceivers 95 are provided. Step 305, at least one engine transceiver 67 is provided. In step 307, a controller 90 is provided. In step 309, the point alignment detection sensor assembly 20, plurality of track transceivers 95, at least one engine transceiver 67 and the controller 90 is installed. In step 311, the railroad locomotive control system having switch position indication 100 is activated. Step 313, subsequent activation of the railroad locomotive control system having switch position indication 100, a detection zone 75 is established proximate the railroad switch 1 being monitored by the railroad locomotive control system having switch position indication 100. In step 315, a railroad switch 1 is positioned so as to be lined for a track. In step 317, the point alignment detection sensor assembly 20 monitors and detects the position of the point blades 5 of the railroad switch 1. In step 319, the point alignment detection sensor assembly 20 detects which track the railroad switch 1 is line for. Step 321, the point blade 5 position is transmitted via either the first transceiver 22 and/or the second transceiver 24 to the track transceivers 95.

In step 323, the track transceivers 95 receive the point blade position signal from the point alignment detection sensor assembly 20. Step 325, each track transceiver 95 transmits the point blade position signal to adjacent track transceivers 95 within the configured detection zone 75. In step 327 the point blade position signal is transmitted to the engine transceiver 67 ensuing the locomotive 98 entering the detection zone 75. Step 329, the engine transceiver 67 receives the point blade position signal. In step 331, the point blade position signal is transmitted to the controller 90. Step 333, the railroad locomotive control system having switch position indication 100 detects a locomotive 98 within a detection zone 75. In step 337, the controller 90 identifies if the point blades 5 are in the correct position for the impending movement through the railroad switch 1 by the locomotive 98. In step 338, the controller 90 determines the point blades 5 are in the incorrect position for the impending movement of the locomotive 98 through the railroad switch 1, i.e. the locomotive 98 will make a trailing movement through a railroad switch 1 being lined thereagainst. In step 339, the controller 90 will provide a first warning signal, wherein the first warning signal is a visual signal provided via the visual indicator 124. Step 341, the controller 90 provides a second warning signal, wherein the second warning signal is an audio alert broadcast via the audio indicator 126. In step 343, the central processing unit 122 of the controller 90 monitors the progress of the locomotive 98 through the detection zone 75 and determines probability of the locomotive 98 passing through the railroad switch 1 with the point blades 5 in the incorrect position. In step 345, the controller 90 will impede the progress of the locomotive 30 through a railroad switch 1 subsequent the calculation that the probability of the locomotive 98 entering the railroad switch 1 having the point blades 5 in the incorrect position is greater than thirty percent. While the thirty percent probability is preferred in the present invention, it is contemplated within the scope of the present invention that the probability could be greater or less than thirty percent.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A railroad locomotive control system for preventing a railroad locomotive from entering a railroad switch wherein the railroad switch has point blades incorrectly positioned for the pending movement therethrough by the railroad locomotive comprising the steps of:

providing a point alignment detection sensor assembly, said point alignment detection sensor assembly having at least one transceiver, said point alignment detection sensor assembly being operably coupled to a railroad switch;

providing a plurality of track transceivers, said plurality of track transceivers being secured to support members of a railroad track proximate the railroad switch to which the point alignment detection sensor assembly is coupled, said plurality of track transceivers being operably coupled to said point alignment detection sensor assembly;

providing at least one engine transceiver, said at least one engine transceiver being mounted to a railroad locomotive, said at least one engine transceiver operably coupled with said plurality of track transceivers;

providing a controller, said controller operable to be mounted in either a first location or a second location, said controller having a central processing unit, said central processing unit operable receive, store, manipulate and transmit data, said controller further operable to provide a first alert signal and a second alert signal, said controller further including an operational control module, said operational control module operably coupled to an engine control unit of a railroad locomotive;

installing the railroad locomotive control system;

activating the railroad locomotive control system;

establishing a detection zone, said detection zone being adjacent the railroad switch, said detection zone having a first portion, said detection zone having a second portion, said first portion of said detection zone and said second portion of said detection zone extending outward from the railroad switch in opposing directions, said first portion of said detection zone having a plurality of track transceivers, said plurality of track transceivers of said first portion including a track transceiver distal to the railroad switch, said second portion of said detection zone having a plurality of track transceivers, said plurality of track transceivers of said second portion including a track transceiver distal to the railroad switch, wherein said detection zone further includes a first operational mode and a second operational mode and in said first operational mode said plurality of track transceivers are in an active monitoring mode;

detecting the position of the point blades of the railroad switch to which the point alignment detection sensor assembly is coupled;

monitoring the position of the point blades;

transmitting a point blade position signal, said point blade position signal being transmitted by said point alignment detection sensor assembly;

receiving the point blade position signal, said plurality of track transceivers receiving the point blade position signal;

transmitting the point blade position signal to said engine transceiver;

receiving the point blade position signal, said point blade position signal being received by said at least one engine transceiver;

detecting a locomotive, wherein the locomotive is detected as traversing through the detection zone;

determining the point blade position relative to the movement of the locomotive;

identifying if the point blades are correctly positioned in the railroad switch through with which the locomotive will execute a movement therethrough;

providing a first alert, said first alert provided if the point blades of the switch being approached by the locomotive are incorrectly positioned;

monitoring the position of the locomotive relative to the railroad switch being approached;

providing a second alert, said second alert provided when no operational change of the locomotive has been detected subsequent providing the first alert;

determining if the locomotive will enter the railroad switch having point blades incorrectly positioned;

executing operational override control of the locomotive subsequent determination that the locomotive will enter the railroad switch having point blades incorrectly positioned.

2. The railroad locomotive control system as recited in claim 1, wherein said first location of said controller is an engine control room of a locomotive and wherein said second location of said controller is a remote control unit.

3. The railroad locomotive control system as recited in claim 2, wherein said first alert is a light.

4. The railroad locomotive control system as recited in claim 3, wherein said second alert is an audio alarm.

5. The railroad locomotive control system as recited in claim 4, wherein in said second operational mode the track transceiver distal to the railroad switch of said first portion of said detection zone and the track transceiver distal to the railroad switch of said second portion of said detection zone are in an active monitoring state.

6. The railroad locomotive control system as recited in claim 5, wherein the first portion of said detection zone and said second portion of said detection zone are approximately four hundred feet to two thousand yards.

* * * * *